United States Patent [19]

Käch

[11] 4,318,064

[45] * Mar. 2, 1982

[54] RESONATOR FOR HIGH FREQUENCY ELECTROMAGNETIC OSCILLATIONS

[75] Inventor: Alfred Käch, Untersiggenthal, Switzerland

[73] Assignee: Patelhold Patentverwertungs- & Elektro-Holding AG, Glarus, Switzerland

[ * ] Notice: The portion of the term of this patent subsequent to Aug. 5, 1997, has been disclaimed.

[21] Appl. No.: 907,578

[22] Filed: May 19, 1978

[30] Foreign Application Priority Data

May 20, 1977 [CH] Switzerland ..... 6279/77

[51] Int. Cl.[3] ..... H01P 1/20; H01P 7/10

[52] U.S. Cl. ..... 333/202; 333/206; 333/219; 333/222

[58] Field of Search ..... 333/82 R, 82 B, 73 C, 333/73 S, 202, 204, 206, 219, 222

[56] References Cited

U.S. PATENT DOCUMENTS

| | | | |
|---|---|---|---|
| 2,929,034 | 3/1960 | Doherty | 333/96 X |
| 3,603,899 | 9/1971 | Gyorgy et al. | 333/95 R X |
| 3,668,574 | 6/1972 | Barlow | 333/96 X |
| 3,703,690 | 11/1972 | Ravenscroft et al. | 333/95 S |
| 3,845,426 | 10/1974 | Barlow | 333/96 X |
| 4,151,494 | 4/1979 | Nishikawa et al. | 333/206 X |

*Primary Examiner*—Paul L. Gensler

*Attorney, Agent, or Firm*—Orville N. Greene

[57] ABSTRACT

A resonator for a high frequency electromagnetic oscillator is disclosed. The resonator includes a hollow cylinder formed of a material having a low dielectric constant and a dielectric wire formed of a material having a higher dielectric constant and located within the cylinder. The dielectric wire has a length similar to that of an open half-wire coaxial resonator or a whole number of multiples thereof. The dimensions of the wire are chosen as a function of the dielectric constants of the hollow cylinder in the dielectric wire as well as the desired resonant frequency such that a standing TEM-wave is established in the hollow cylinder and a $E_{0m}$-wave (circular magnetic field, m=1,2,3 . . . ) is established in said wire.

22 Claims, 11 Drawing Figures

RESONATOR FOR HIGH FREQUENCY ELECTROMAGNETIC OSCILLATIONS

BACKGROUND OF THE INVENTION

The present invention relates to resonators for high frequency electromagnetic oscillators. The most important characteristics of resonators of this type are its resonant frequencies $f_0$ and its quality factor Q. The present invention is directed towards a resonator which is small in volume but exhibits a high quality factor.

Prior art resonators may be divided into two principal categories; open systems and shielded systems. Both classes of resonators are often used in frequency tuned circuits, for example, in the form of bandpass filters or band rejection filters. Open systems, such as Fabry-Perot resonators, microstrip resonators, and certain dielectric resonators, are useful in circuits with relatively low selectivity requirements while shielded systems such as different coaxial and cavity resonators, triplate resonators and yet other dielectric resonators, are useful in circuits requiring relatively high selectivities. Microstrip or triplate resonators are circuit elements employing the unsymmetric and symmetric stripline techniques, respectively. Typical constructions are the open half-wave resonator, the circular disk and the circular ring resonators.

Resonators which exhibit a high degree of reproducibility, small size, high consistency of performance and low cost are preferred. When designing such resonators it is desirable to avoid high galvanic losses which result in relatively low quality factors. With particular reference to microstrip resonators, it is desirable to minimize reflection and dielectric losses. Generally speaking, stripline bandpass filters exhibit relatively high filter losses and relatively low selectivity. For this reason, such filters are suited chiefly for circuit applications which place no special requirements on transmission quality.

Dielectric resonators are volume resonators and are used in stripline resonators as well as cavity resonators. Such resonators may take the form of discs, rings, cylinder or square blocks. Open resonators can be divided into three broad categories; one, two and three-dimensional open resonators. In order for an open resonator to oscillate the electromagnetic field must propagate in the open direction or directions according to an experimental or modified Hankel function. The particular behavior of the open resonator depends upon the dimensions and material constants of the dielectric bodies as well as the instantaneous operating frequency of the resonator. The quality factor Q of either a one or a two-dimensional open resonator is determined by the dielectric and galvanic losses of the resonator. The quality factor of the three-dimensional open resonator is determined by dielectric and radiation losses of the resonator.

Universally shielded resonators are advantageous since they make it possible to obtain especially high quality factors, if the size of the shield is at least twice the largest dimension of the dielectric resonator. With dielectric resonators, however, it is not possible to obtain quality factors which are higher than the characteristic value $\cot\delta$($\delta$=loss angle), of the dielectric material.

Although the dielectric resonator is fully described in the literature, one finds few practical uses for it. One reason is the relatively small intervals which exist between successive resonant frequencies. In addition, certain problems are encountered when constructing such filtered structures. Thus, to obtain low filter losses, highly loss-free dielectrics are required.

Coaxial quarter-wave resonators are especially useful in tank circuits for multiple circuit filters e.g. as bandpass filters with comb-like (combline) or finger-like (interdigitally) arranged conductor structures. The preferred frequency range of such structures is between 500 MHz and about 5 GHz, whereby it is possible to attain quality factors as high as two to three thousand.

Cavity resonators are primarily useful in circuits where low transmission losses with high selection are required. For example, cavity resonators are useful as antenna filters in highly sensitive microwave receivers. In most cases, the quality factor of such resonators lies in the range of 5,000 to 10,000. However, these resonators require a relatively large volume in the low frequency range and are therefore relatively heavy. In some instances, metalized ceramic bodies are utilized to reduce the weight of cavity resonators. Such resonators, however, are expensive and different to construct.

It has been found that regardless of the resonators utilized, high quality factors can be realized only with resonators having a large conductor surface area and/or a large cavity volume. This is a result of the isotropy of the mediums which always penetrate into the resonator cavity of the electromagnetic field.

BRIEF DESCRIPTION OF THE INVENTION

A primary object of the present invention is to provide resonators for electromagnetic oscillators which have a small volume but exhibit a high quality factor. To this end, the present invention is directed to a resonator comprising an electromagnetically shielded hollow cylinder formed of a material with a low dielectric constant and a dielectric wire situated within said cylinder and formed of a material having a high dielectric constant. As a result of this relationship between the dielectric constants of the hollow cylinder and the dielectric wire formed within the hollow cylinder an $E_{0m}$-wave (circular magnetic field, m=1, 2, 3 . . . ) is excited within the dielectric wire. The dimensions of the dielectric wire are chosen to approximate those of an open end half-wave coaxial resonator or a whole multiple thereof. The particular length of the dielectric wire is chosen to establish, at least approximately, a standing TEM wave in the space of the dielectric hollow cylinder. This relationship is determined as a function of both the dielectric constants of the dielectric materials and the actual resonant frequency of the oscillator.

In the simplest case, a circular metallic tube functions as the electromagnetic shield of the oscillator and defines the outer boundary of the area of the hollow cylinder. The hollow cylinder consists primarily of air and totally encompasses the dielectric wire positioned within the metallic tube. The excited $E_{0m}$-wave in the dielectric wire is preferably the $E_{01}$-wave (i.e. the $TM_{01}$ mode).

The invention will now be further explained with the aid of the drawing and a mathematical explanation in agreement therewith.

DETAILED DESCRIPTION OF THE INVENTION

Figure 1A:
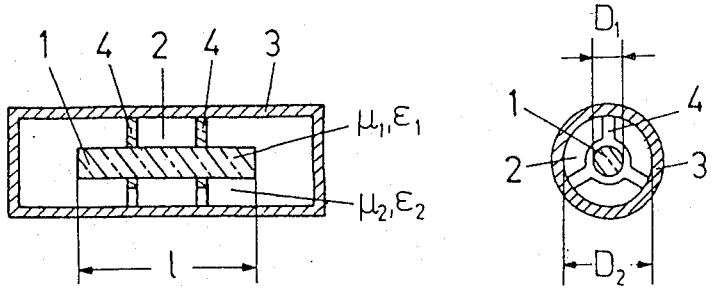
FIG. 1A illustrates a resonator constructed in accordance with the principles of the present invention.

FIG. 1A shows a preferred form of the structure of the invention in a longitudinal cross-sectional view. The dielectric wire 1, having a permeability $\mu_1$, a dielectric constant $\epsilon_1$, and a diameter $D_1$ is arranged concentrically in a circular cylindrical metal tube 3 which has an inner diameter $D_2$. The medium 2 in the intermediate space, for example air, has a permeability $\mu_2$ and a dielectric constant $\epsilon_2$ and defines a hollow cylinder of dielectric material. $\mu_2$, $\epsilon_2$ is selected to be much less than $\mu_1$, $\epsilon_1$. The diameter $D_1$ and the length l of the dielectric wire 1 are chosen such that, at the actual resonance frequency in the cylinder 2, at least an approximate standing TEM-wave is developed in the cylinder 2. This relationship is further defined in the section entitled "Theoretical Findings", below.

Figure 2:
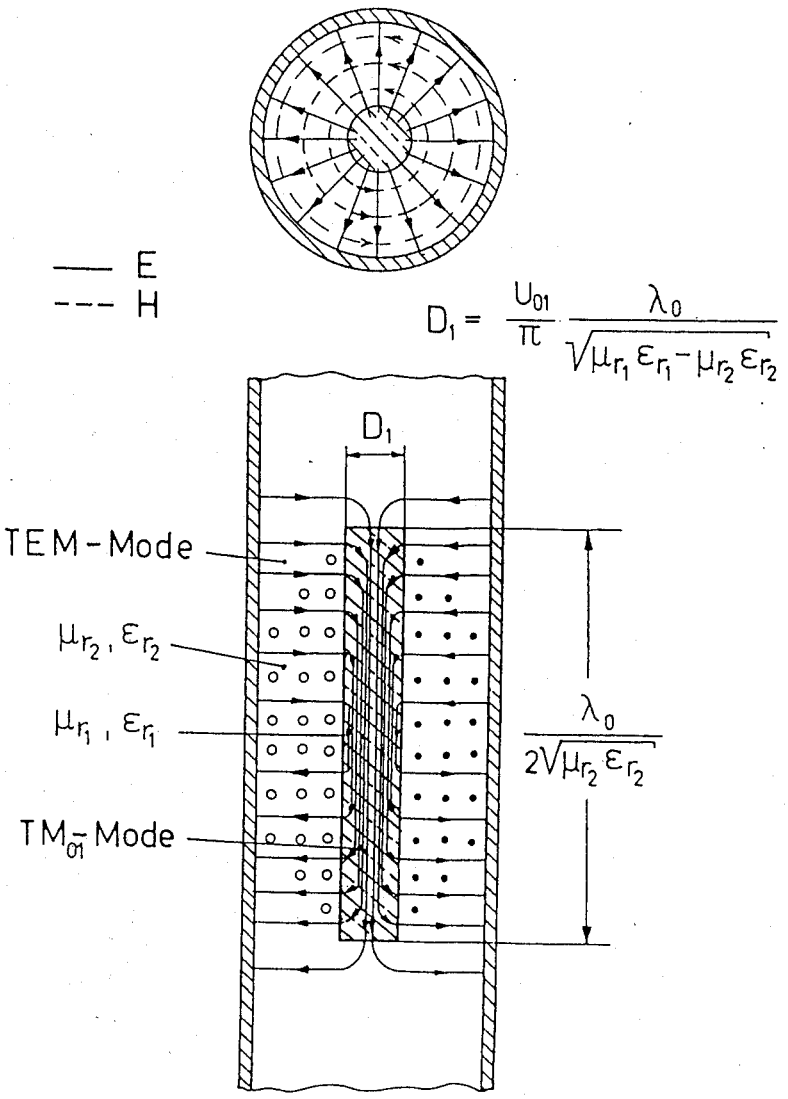
FIG. 2 illustrates the field distribution created upon the excitation of a $E_{01}$-wave in the wire of the resonator of the present invention.

FIG. 2 illustrates the field distribution which is created upon the excitation of the $E_{01}$-wave (i.e. the $TM_{01}$ mode) in wire 1 according to the invention. Since $\mu_2\epsilon_2<\mu_1\epsilon_1$, the electric field E extends in radial direction from the conductor axis. By properly selecting the Diameter $D_1$ of the wire 1 in relation to both the material constants $\mu_1$, $\epsilon_1$ and $\mu_2$, $\epsilon_2$, and to the instantaneous operating frequency of the resonator, a field pattern is established wherein the longitudinal component of the electric field disappears from the surface of the dielectric wire 1. The electromagnetic field in the dielectric hollow cylinder 2, that is, in the space between the dielectric wire 1 and the metal tube 3 (see FIG. 1A) is therefore quite similar to the field established between the inner and outer conductors of a coaxial line (TEM-wave). The phase velocity of the electromagnetic wave propagating in both directions (i.e. a standing wave) is therefore determined by the operating frequency and the material constants $\mu_2$, $\epsilon_2$ of the dielectric hollow cylinder 2. By selecting the length l of the dielectric wire 1 so that the momentary phase difference on the wire end amounts to 180° (or a whole number multiple thereof), a resonator according to the invention is obtained.

The induction (and distribution) of the field components with a dielectric wire is naturally different from that with galvanic conducting. As a result, the resonator of the present invention behaves in a completely different manner than conventional coaxial conductor resonators. This difference is reviewed in detail below.

In the practical application of the present invention, it is desirable to select $\mu_2=\mu_1=\mu_0$ and $\epsilon_2=\epsilon_0$ since the influence with respect to these material constants is most favorable (see "Theoretical Findings", below). In addition, the carrier medium should be as loss-free as possible. To this end, it is desirable to mount the dielectric wire in the metal tube 3, utilizing two three-armed bridges of plastic or ceramic material (designated in FIG. 1A by 4), with the length of the wire 1 approximating that of a half-wave resonator, so that electrical disturbances are mutually destroyed. The wire 1 is affixed to the end or side of the metal tube 3 by means of dielectric pins. The intermediate space 2 may be filled with foam or other material.

Figure 1B:
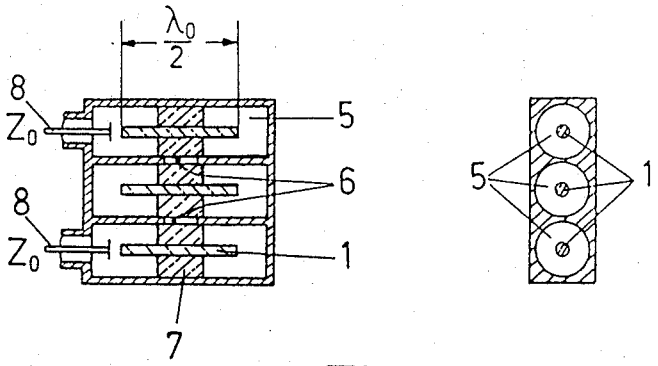
FIG. 1B illustrates a first embodiment of a three circuit filter using the resonator of the present invention.
Figure 1C:
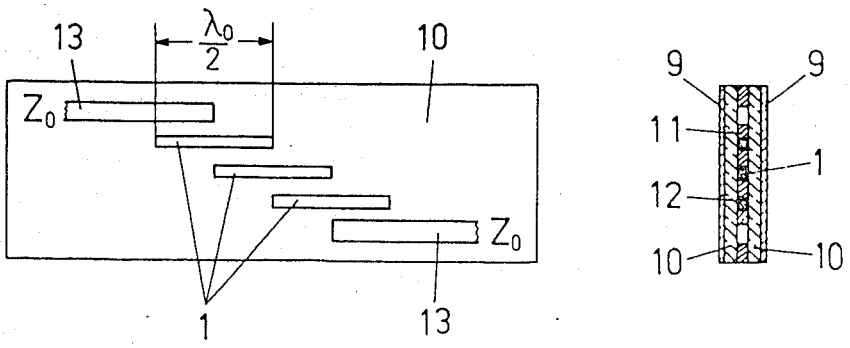
FIG. 1C illustrates a second embodiment of a three circuit filter using the resonator of the present invention.

With the aid of the basic form shown in FIG. 1, different varieties and constructions of the resonators are possible. Quarter wave resonators possess significantly lower quality factors due to the losses at the bottom surface. A favorable construction can be obtained, e.g. by the combination circuit of two half-wave resonators with a circular-form, ring conductor. The individual structure will be further gone into later (see the section entitled "Technical Advance", below) in connection with the use in filter circuits, where the explanation of FIGS. 1B and 1C are included.

The resonator is suited preferably for fixed frequency operation. Within certain ranges, a fine tuning is also possible, e.g., by means of capacitive and/or inductively operated plug.

With the field strength, according to the exponential function constrained between the dielectric wire 1 and wall of tube 3, a regenerative amplification apart from the tube, is not possible. Also, a resonance is not possible apart from the dielectric wire 1, as long as the diameter of tube 3 is held below the boundary diameters. Both structural parts are essential for the functioning of the resonance system. The dielectric wire 1 causes the formation of a field which has no longitudinal component on the surface of wire 1. This condition is especially true if an $E_{01}$-wave is established in wire 1. The tube 3, on the other hand, guarantees the existence of the TEM-wave in the dielectric hollow cylinder 2. The momentary field strength distribution in the dielectric resonator resembles that in the dielectric wire 1 only in the radial direction. In the longitudinal direction it resembles that of a coaxial half-wave resonator. The resonance system forms neither a hollow cavity resonator, nor a pure dielectric resonator. Accordingly, it is properly labeled a Quasidielectric or QD resonator.

The favorable behavior of the resonator of the present invention appears first at the upper half of a certain cut-off frequency which is determined by the diameter $D_2$ of tube 3 and by the dielectric constant of the dielectric wire 1. The border condition of this resonator is $D_1=D_2$ wherein the arrangement corresponds exactly to a one-dimensional open dielectric resonator. The resonance system can be used up to the frequency range of the mm-waves. The practical use of the resonator is limited by the types of dielectric material available for making the dielectric wires. With very high frequencies, materials with relatively low dielectric constants are suitable, while in the microwave range, down to the dm wave ranges, materials with higher or very high dielectric constants must be used.

THEORETICAL FINDINGS

The advantages of the present invention may be demonstrated by comparing the characteristics of the present resonator with those of the know resonators (e.g. stripline, coaxial, and cavity resonators). To this end, the theoretical characteristics of the present invention will be developed. While the characteristics will be developed with respect to resonators utilizing conductors having circular cross-sections, the results are applicable to conductors having other cross-sections when certain conditions are met (see "Technical Advance" below), e.g., rectangular and elliptical arrangements with plate-like shielding.

(a) General considerations:

The resonator of the present invention is an improvement of prior U.S. application Ser. No. 868,840 entitled "Waveguides for the transmission of electromagnetic Energy", also called "Quasidielectric Wave Guide". The connections for a conduction system, with two layered dielectrics under the separate parameters, are therefore also governing here. They are mentioned in the following only inasmuch as is necessary for the description of the resonator characteristics.

The actual phase constant $\beta$, in a conducting system with layered dielectrics propagating hybrid modes ($HE_{nm}$-waves, $EH_{nm}$-waves) can be used to determine the quality factor of the resonator. In the present case, these are functions of the material constants of the dielectric wire ($\mu_1$, $\epsilon_1$,) and of the dielectric hollow cylinder ($\mu_2$, $\epsilon_2$), the diameter proportions $a=R_2/R_1=D_2/D_1$, and the pair of values x,y. x and y are defined as follows:

$$x^2 = (\omega^2\mu_1\epsilon_1 - \beta^2)R_1^2, \quad (1)$$
$$y^2 = (\omega^2\mu_2\epsilon_2 - \beta^2)R_1^2, \quad (1a)$$

wherein $\omega=2\pi f$ and f is the operating frequency of the resonator. Subtracting equation (1a) from equation (1), we get:

$$x^2 - y^2 = \omega^2(\mu_1\epsilon_1 - \mu_2\epsilon_2)R_1^2 \quad (2)$$

and $$\beta = \frac{1}{R_1}\sqrt{\frac{x^2\mu_2\epsilon_2 - y^2\mu_1\epsilon_1}{\mu_1\epsilon_1 - \mu_2\epsilon_2}}, \quad (3)$$

wherein it is assumed that the material constants of wire 1 and hollow cylinder 2 are chosen such that: $\mu_1\epsilon_1 > \mu_2\epsilon_2$.

To calculate the resonator properties, the relatively simple special case, which applies to the previously proposed wave guide, may be used. Particularly, it may be assumed that interaction of the particular material constants are directly related to the actual operating frequency of the wave guide so that its phase constant has the value $$\beta = \sqrt{\omega\mu_2\epsilon_2} \quad (4)$$

and therefore depends then only on the angular velocity $\omega$ of the traveling wave and the material constants, $\mu_2$, $\epsilon_2$, of the dielectric hollow cylinder 2. If $\mu_2=\mu_0$, $\epsilon_2=\epsilon_0$, the propagation speed of electromagnetic waves corresponds exactly to the speed of light in free space.

Substituting equation (4) into equation (1a), we get y=0 and with it, according to the eigen value equation, $$J_n(x) = 0 \text{ or } x = u_{nm} \quad (5)$$

for $HE_{nm}$-waves ($u_{nm}=m^{th}$ root of the Bessel function $n^{th}$ order). In the special case n=0, $$J_o(x) = 0 \text{ or } x = u_{om} (= 2;4048 \text{ for } m = 1) \quad (6)$$

for $E_{0m}$-wave. With the above pair of values ($x=u_{mn}$, y=0), according to the equations (3) and (4), there is specified immediately the necessary wire diameter $D_1$ at any given time for the specific $HE_{nm}$-wave stated. After a slight calculation, the following is attained:

$$D_1 = \frac{u_{nm}}{\pi} \frac{\lambda}{\sqrt{\mu_{r1}\epsilon_{r1} - \mu_{r2}\epsilon_{r2}}}, \quad (7)$$

where $\lambda$ stands for the operating wave length of the oscillator in free space and $\mu_r$, $\epsilon_r$ means henceforth the relative material constant of the respective dielectric.

With reference to the losses and quality factor of the resonator, significant values are derived only for the $HE_{nm}$-wave where n=0 (preferably the $E_{0l}$-wave). The quality factor for the $EH_{nm}$-wave, inclusive of the $H_{0m}$-wave are therefore omitted here.

(b) Resonance frequency.

Let us take an interesting practical case, namely an open half-wave resonator (according to FIG. 1A), excited so as to establish an $E_{0l}$-wave (m=1) in the wire 1. With the given resonance wave length $\lambda_o$ in free space and the given material constants it follows from Equation (7) with $u_{nm}=u_{0l}=2.40482$ that the actual wire of the diameter should be:

$$D_1 = \frac{u_{01}}{\pi} \frac{\lambda_o}{\sqrt{\mu_{r1}\epsilon_{r1} - \mu_{r2}\epsilon_{r2}}} \quad (8)$$

and from Equation (4), with $\beta l=\pi$, that the actual wire length l should be:

$$l = \frac{\lambda_o}{2\sqrt{\mu_{r2}\epsilon_{r2}}} \quad (9)$$

In Equation (9) the possible fringe effects are omitted for the sake of simplicity. The error, however, as in conventional half-wave resonators, amounts at most to 10%. The diameter of the resonant elements has such a relation to the length that $$\frac{D_1}{l} = \frac{2u_{01}}{\pi}\sqrt{\frac{\mu_{r2}\epsilon_{r2}}{\mu_{r1}\epsilon_{r1} - \mu_{r2}\epsilon_{r2}}} \quad (10)$$

($2u_{0l}/\pi \cong 1.531$). In a specially interesting practical case where $\mu_{r2}=\mu_{r1}=1$, $\epsilon_{r2}1$ and $\epsilon_{r1}=\epsilon_r$, the diameter and length of the wire 1 are:

$$D_1 = \frac{u_{01}}{\pi} \cdot \frac{\lambda_o}{\sqrt{\epsilon_r - 1}} \quad (11)$$

and

-continued $$l = \frac{\lambda_o}{2}. \tag{12}$$

For the determination of size of the resonance elements there are accordingly two conditions to be observed. Eq. (11) provides a wire diameter value which will cause a standing TEM-wave to be established in the space outside the dielectric wire and Eq. (12) provides the corresponding resonance length.

Additionally, it should be noted that the enclosing housing 3 of the resonator produces no interfering resonances provided that the tube diameter $D_2$ is sufficiently low that it lies above the basic diameter for the $E_{om}$-wave (without resonance element). Thus, $D_2$ must meet the following conditions:

$$D_2 \leqq \frac{u_{01}}{\pi} \frac{\lambda_o}{\sqrt{\mu_{r2}\epsilon_{r2}}} \tag{13}$$

or since $2u_{0l} = 1.531 \cdot \pi$ and in view of equation (9):

$$D_2 \leqq 1.5 \cdot l, \tag{14}$$

As a practical matter, this requirement is almost always followed. As a result, tube 3 can then be left open on the front end without any loss of energy due to radiation losses.

(c) Quality Factor

In the case of y=0 the field component approximates the Bessel function only in the dielectric wire 1, and is a pure exponential function in the medium 2. If an $HE_{nm}$-wave is established, no longitudinal components of the field exist in the space beyond the wire 1. Consequently, the energy fed into the resonator, as well as the galvanic and dielectric losses and therewith the explicit quality factor, can be exactly calculated. Assuming that the dielectric material between the dielectric wire 1 and the metal tube 3 is free of losses (it is further assumed that the field distribution with losses closely approximates that of the loss-free case) and omitting the terminal losses, the quality factor may be expressed as follows:

$$Q\Big|_{y=0} = \frac{\frac{\mu_1}{\mu_2} + \frac{\epsilon_1}{\epsilon_2}\tanh^2(n \cdot \ln a) + \frac{2}{n}\tanh(n \cdot \ln a)}{\left[\frac{\mu_1}{\mu_2} + \frac{\epsilon_1}{\epsilon_2}\tanh^2(n \cdot \ln a)\right]\tan\delta + \frac{\theta_o}{R_2}\frac{\mu_L/\mu_2}{\cosh^2(n \cdot \ln a)}} \tag{15}$$

Wherein $\delta$ = the loss angle of the dielectric wire 1, $\mu_L$ is the permeability of the shielding tube 3 and $$\theta_o = \frac{1}{2\pi}\sqrt{\frac{\lambda_o}{30\sigma\mu_{rL}}}\ \text{cm} \tag{16}$$

designates the degree of penetration the electromagnetic field in the wall of tube 3 ($\sigma$ is the electric conductivity of tube 3). Equation (15) is written so as to demonstrate the individual terms required for the computation of the quality factor so that one can easily recognize the influence of these values on the quality factor.

In a specifically interesting practical case, namely for $\mu_{rL} = \mu_{r2} = \mu_{r1} = 1$ and $\epsilon_{r2} = 1$, $\epsilon_r$, equation (15) becomes:

$$Q\Big|_{y=0} = \frac{1 + \epsilon_r\tanh^2(n \cdot \ln a) + \frac{2}{n}\tanh(n \cdot \ln a)}{[1 + \epsilon_r\tanh^2(n \cdot \ln a)] \cdot \tan\delta = \frac{\theta_o}{R_2}\frac{1}{\cosh^2(n \cdot \ln a)}} \tag{17}$$

(valid for $HE_{nm}$-waves, n=0, 1, 2, 3 . . . ). With the wire diameter $D_1$ as defined in Equation (7) and assuming a tube diameter $D_2$, the ratio between the two diameters ($a = D_2/D_1$) is:

$$a = \frac{\pi}{u_{nm}} \cdot \frac{D_2}{\lambda_o} \cdot \sqrt{\epsilon_r - 1} \tag{18}$$

Here it should be noted that a must always be $\geqq 1$. $\epsilon_r$ must also be a certain minimum value for each root of $u_{nm}$. This value can be determined from Eq. (18) for a=1. In such a case, Eq. (18) becomes:

$$\epsilon_r \geqq 1 + \left(\frac{u_{nm}}{\pi}\right)^2 \cdot \left(\frac{\lambda_o}{D_2}\right)^2. \tag{19}$$

Eq. (17) shows a very interesting behavior. For n>>1 follows next $$Q\Big|_{y=0} \cong \cot\delta \tag{20}$$

The quality factor corresponds to the Eigen valve of the material of the dielectric wire and indeed is extensively independent of the values $\epsilon_r$, n and a. If on the contrary n=0 (main mode), it follows from (17)

$$Q\Big|_{\substack{y=0\\n=0}} = Q_o = \frac{1 + 2 \cdot \ln a}{\tan\delta + \frac{\theta_o}{R_2}} \tag{21}$$

In this case, the quality factor increases constantly with increasing $\epsilon_r$ and indeed proportionately with ln a, whereby a, by Eq. (18) for n=0 is given. Theoretically, one can also attain unlimited quality factors with very high $\epsilon_r$-values and indeed independent of the galvanic and dielectric losses. The basis for this behavior lies, as the calculation shows, in that the energy for n $\geqq 1$ is predominantly in the dielectric wire 1. In contrast, for n=0 a majority of the energy is stored outside the dielectric wire 1. The field components, and therewith the density of energy for n=0, on the outside of the surface of wire 1 with declining wire diameter takes on a very high value so that the energy storage results predominantly there. This also explains the fact that with increasing proportions of $a = D_2/D_1$, the influence of the galvanic and dielectric losses in the same measure is diminished.

Figure 3:
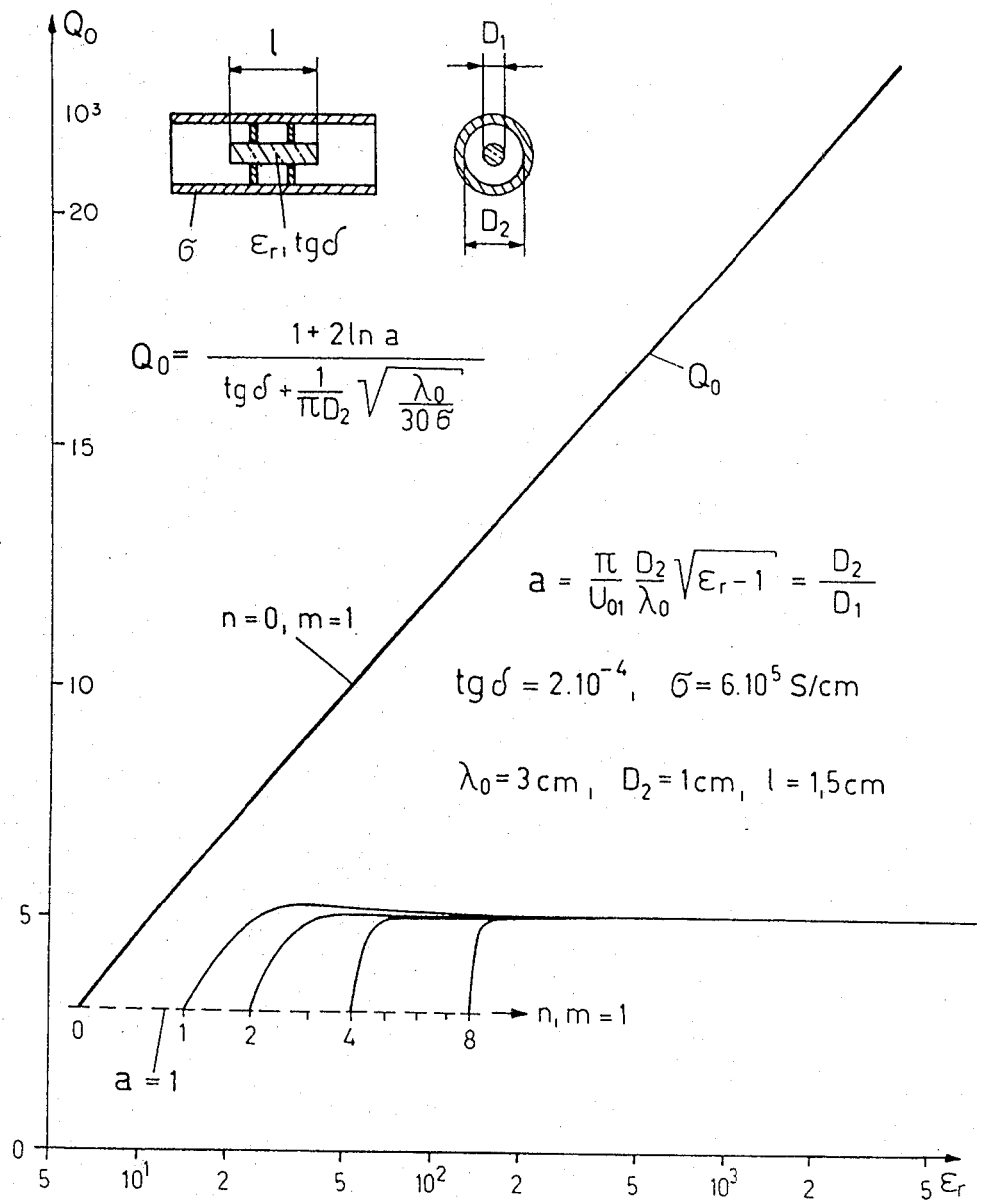
FIG. 3 is a graph illustrating the quality factor of the present invention as a function of the relative dielectric constant.

FIG. 3 shows an Example of the behavior of the quality factor calculated with Eq. (17) as a function of the dielectric constant $\epsilon_r$ for n=1, 2, 4, 8 and m=1. Assume: f=10 GHz, $\lambda_o$=3 cm, inner diameter of shielding tube $D_2$=10 mm, resp. and further tan $\delta = 2 \cdot 10^{-4}$, $\sigma = 60 \cdot 10^4$ S/cm. While for n$\geqq$1 the quality factor of the dielectric wire very soon tends to the characteristic or Eigen value $\cot\delta=5000$, it increases continually for $n=0$. Already with relatively low $\epsilon_r$-values significant differences result. For $\epsilon_r=100$, e.g., already $Q_o=12000$, during which $a=4.33$, i.e., the diameter of the dielectric wire still amounts to 2.31 mm with a length (according to Eq. (12) of $l=15$ mm.

From all possible wave types, the $E_{0m}$-waves are the only ones by which the quality factors increase continually with increasing dielectric constant of the dielectric wire. The most favored case results for $m=0$ (first root of $J_o(x)=0$, $x=u_{0l}=2.4048$), since then after Eq. (7), the necessary wire diameter $D_1$ takes on the smallest value and/or according to Eq. (18) the proportion $a=D_2/D_1$ for a given value $D_2/\lambda$ and $E_r$ shows the highest amount.

As Eq. (15) for $n=0$, after insertion of the values a and $\phi_o$ from Eqs. (16) and (18), shows that $Q_o$ increases so much the greater $\epsilon_r$, $D_2$ and $f_o$ are. The variation of $Q_o$ is altogether constant and one way. There exists here no extreme optimal condition as is the case, e.g., with the attenuation constant of the corresponding wave guides.

As Eq. (15) shows with regard to the influence of the remaining material constants for $n=0$, one can additionally increase quality factor by making $\mu_{r2}>1$, i.e., the space 2 between the dielectric wire 1 and the shielding tube 3 can be filled e.g. with ferrite. Now such permeable materials, however, have also a relative dielectric constant $>1$ and to them must also be charged a loss angle so that the quality factor becomes smaller sooner than larger. The case $\mu_{r1}>1$ as also making the tube conductor from a permeable material ($\mu_{r1}>1$) has likewise a lower quality factor to follow. Further, the proportion should be as large as possible in Eq. (15) for $n=0$ in $a=D_2/D_1$ to hold (See Eq. (18)). The above supposition $\mu_{rL}=\mu_{r2}=\mu_{r1}=1$ and $\epsilon_{r1}=1$ of these material constants yield the most favorable relative influence on the quality factor of the resonators.

By supposing a loss angle $\delta$, on the dielectric hollow cylinder one obtains the denominator in Eq. (21) the form, $$N = \tan(\delta_1) + 2\mathrm{tg}(\delta_1)\cdot\ln a + \frac{\theta_o}{R_2}. \tag{22}$$

The favorable behavior of $Q_o$ according to Eq. (21) then does not exist. With increasing $\epsilon_{r1}$, the tendency is Q approaches cot $\delta_2$ therefore the losses in the dielectric hollow cylinder should be held as small as possible.

In the case of the quarter wave length QD-resonators ($l=(2p-1)\cdot\lambda_o/4$, $p=1, 2, 3\ldots$) the denominator in Eq. (21) appears to behave as the expression $$N = \tan\delta_1 + \frac{\theta_o}{R_2} + \frac{\phi_o}{l}\cdot(1 + 2\cdot\ln a). \tag{23}$$

Also here the most favorable behavior of Q according to Eq. (21) is disturbed. With increasing $\epsilon_{r1}$, the tendency is for $Q\rightarrow l/\theta_o$. The galvanic losses in the base plate goes, among other things, so much smaller the greater the length l of the resonator can be made. The quality is valid also for the short circuited end, half-wave-resonator.

In case a resonator includes only pure conduction losses, its quality factor is independent of its length. Possible terminal losses always distribute themselves in their effect along the total length of the resonator. The result, therefore, is that the longer the resonator is, the less the contribution of the terminal loss.

Figure 4:
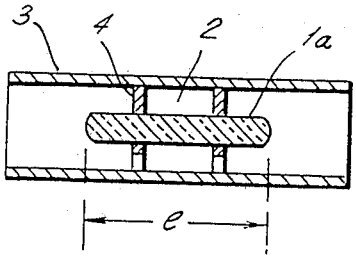
FIGS. 4 and 5 show side views in section of two additional embodiments of the resonator of the invention.
Figure 6A:
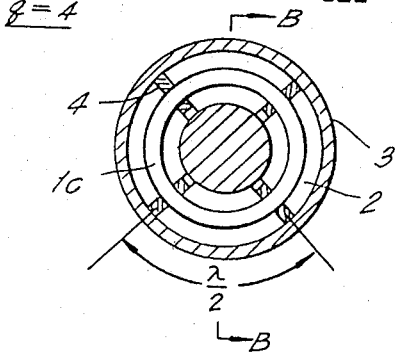
FIG. 6A is a sectional front view as seen from section line A—A of FIG. 6B of yet another embodiment of the resonator of the invention.
Figure 6B:
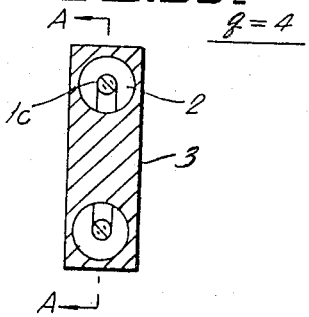
FIG. 6B is a sectional side view as seen from section line B—B of FIG. 6A of the embodiment of FIG. 6A.

Also, as proposed, at the open end of a QD-resonator, appreciable end losses can occur with certain diameter proportions as a result of field distortion. These can be reduced through suitable camber of the end surface and/or rounding off of the end edges. This embodiment is shown in FIG. 4, where the ends of dielectric wire 1*a* are rounded. They fall out completely in cases where the QD-resonator consists e.g., of a circular dielectric ring (FIGS. 6A and 6B).

(d) Comparison with coaxial conductor resonator.

The advantageous behavior of QD-resonators results already form the example of FIG. 3. The advantage e.g., over the stripline resonator, namely essentially higher quality factor, with approximately the same dimensions, are obvious. Also, up against the dielectric resonator, it produces significantly better quality factors. In principle, even the very high quality factor of the cavity resonator can be realized for which, among other things, materials with relatively high $\epsilon_r$-values are necessary. The unusual properties of QD-resonators are shown especially in comparison with the behavior of conventional coaxial line resonators.

The quality factor of the open half-wave coaxial resonators is, assuming similar material constants of the conductor and air as the intermediate medium, determined through $$Q^{KA} = \frac{\ln b}{1+b}\cdot\frac{D}{\theta}, \tag{24}$$

wherein the diameter proportion, $b=D/d$, is in the numerator as well as in the denominator. The maximum of this function lies with $b_{opt}=b_o=3.6$. This gives for the highest possible value:

$$Q^{KA}_{max} = Q^{KA}_o = \frac{1}{b_o}\cdot\frac{D}{\theta}. \tag{25}$$

The values $b_o$ and D are independent from the actual resonant frequency. The comparison of Eq. (25) with (21) supplies now an equation of condition therefor, which loss angle of the material of the dielectric wire can be the highest, by means of which the quality factor of the QD-resonator is equal to or higher than that of the conventional half-wave coaxial resonators. For $\lambda=\lambda_o$ and $D=D_2$, it follows from Eq. (25), after a single transposition, $$\tan\delta \leqq \left[3 + 2\cdot\ln\left(\frac{a}{b_o}\right)\right] / Q^{KA}_o, \tag{26}$$

wherein $a=D_2/D_1$ with given value $D_2/\lambda_o$, and $\epsilon_r$ is determined through Eq. (18) ($u_{nm}=u_{01}=2.4082$). The highest permissible value at any given time increases proportionately to ln a. By way of example, for $a=b_o$ and $Q_o^{KA}=2500$, the requirement follows: $\tan\delta\leqq 12\cdot10^{-4}$. Only at a very bad loss angle does the ability of the dielectric wire to compete with the QD-resonators with respect to quality perceptably deteriorate.

Functionwise, the QD-resonator behaves as a conventional coaxial line resonator whose inner conductor is conducting infinitely well and in return the outer conductor has a suitable lower conductivity. An open half-wave coaxial resonator in which the conductivity of the inner conductor is accepted as $\sigma_1=\infty$, has with $\theta$ according to Eq. (16) the quality factor:

$$Q_o^{KA} = 2\pi D\sqrt{\frac{30\sigma_r}{\lambda}}\cdot \ln b, \tag{27}$$

wherein $b=D/a$ can then be any random value and $\sigma_r$ indicates a suitable modified conductivity of the outer conductor. The comparison with Eq. (21) gives with $\lambda=\lambda_o$, $D=D_2$, and $\theta$ from Eq. (16) as to numerator and denominator the identities:

$$\tfrac{1}{2} + \ln a = \ln b, \tag{28}$$

$$\frac{1}{\pi D_2}\sqrt{\frac{\lambda_o}{30\sigma_r}} = \tan\delta + \frac{1}{\pi D_2}\sqrt{\frac{\lambda}{30\sigma}}, \tag{29}$$

and from these, the assigned diameter of the inner conductor to $$d = \frac{D_1}{\sqrt{e}} \tag{30}$$

($e=2.71828$) and for the resulting conductivity $$\sigma_r = \frac{\sigma}{\left[1 + \pi D_2\sqrt{\frac{30\sigma}{\lambda_o}}\cdot\tan\delta\right]^2}. \tag{31}$$

The denominator in Eq. (31) is independent of the proportion $a=D_2/D_1$. The loss of the dielectric wire appears in the action in the form of additional losses in the outer conductors. This transformation establishes that according to Eq. (21) the quality factor is influenced only in the numerator in the function of ln a (in contrast to the conventional coaxial resonator, see Eq. [24]) and therefor for very small wire diameter ($a\rightarrow\infty$) can take on any high value. The QD-resonator corresponds classically exactly to a conventional coaxial conducting resonator with an open end whose inner conductor has infinitely high conductivity, thus to a certain degree is superconducting.

Technical Advance

While all known types of resonators for a high quality factor with the least dielectric losses ($\tan\delta=0$) require a large volume structure, the resonator of the present invention achieves high quality factors with a small volume. Through the dielectric as the dielectric constant of the wire 1 increases, the energy density is concentrated in greater quantities in the region of the surfaces of wire 1. At the same time, the wire itself is increasingly tuned out of the surrounding field. In the borderline case of a very high dielectric constant, the energy storage results only in the center of the shielding tube 3 along the surface of the wire 1. As a result, and as explained in the foregoing section, an exceptionally high quality factor can be obtained. The necessary condition for this phenomenon is that predominantly only an electric radial field is present in the surface of wire 1. This field is weaker in the dielectric wire 1 than outside the wire by a factor of about $\epsilon_1/\epsilon_2$. This factor also corresponds to the portion of energy stored in the wire 1. By choosing the diameter of wire 1 such that the base mode ($E_{01}$-wave) of a standing TEM-wave is established in the space between the wire 1 and the shielding tube 3, this condition is necessarily fulfilled at the resonant frequency. With all other field structures (i.e. the $HE_{nm}$-wave ($n=1, 2, 3\ldots$) and the $EH_{nm}$-wave ($n=0, 1, 2, 3\ldots$)), an $E_Q$ component always exists. This is, however, the transition condition for the tangential fields on the boundary surface in the interior of the wire 1 as well as the outside of the wire 1. The parts of the energy which are stored in the wire 1 by this method are also correspondingly high and losses connected therewith, so that the highest quality factor Q corresponding to the characteristic value $\cot\delta$ of the dielectric wire, can be attained. The $E_{Om}$-waves (especially the $E_{01}$-wave) are in fact, the only type with which one can, with the smallest volume, obtain such a high quality factor. The basic mode (i.e. the $E_{Om}$-wave) of the dimensioned dielectric wire 1 is the only existable wave in the near surroundings. Higher wave types are possible with corresponding higher frequency, with the illustrated half-wave-QD-resonator, e.g., referring to radial direction corresponding $u_{02}=5.5201$ with $f=2.3\ f_o$, referring to longitudinal direction $f=2\ f_o$. The actual value ought to lie therebetween. The next higher resonance frequency also lies at least more than double the base frequency, which spacing, in comparison to that with a dielectric resonator is essentially favorable.

Basic importance belongs to the resonator of the invention. For the first time, a resonance system for electromagnetic oscillators is shown which energy storage to the limiting case (for $\epsilon_r\rightarrow\infty$, i.e., $D_1\rightarrow 0$, $D_2\neq 0$, no matter how small), an infinitely high quality factor with diminishing volume, is obtained, and this value is independent of the actual galvanic and dielectric losses. This quality is possible because the QD-resonator, as shown in the previous section, corresponds to a coaxial conductor resonator whose inner conductor has an infinitely high conductance.

Practically, one can approach arbitrarily near to this ideal case in so far as the necessary dielectrics are available. In the higher frequency range, one can already attain considerably high quality factors with proportionately low $\epsilon_r$-values, while in the microwave range down to the dm-waves, higher to very high dielectric constants are necessary.

As shown on the circular form coaxial resonator structure, the dimensions of the dielectric wire are so chosen that with a given dielectric constant and resonant frequency, at least something approaching a standing TEM-wave adjusts itself in the space between the wire 1 and the shielding tube 3. These field components, as mentioned, are pure experimental functions, heed also the two dimensional differential equation and with it also to the calculating rules of conformal transformation. One can deduce therefrom that the results explained here for the coaxial resonator, at least approximately hold true for the conductor which can be derived from the field between two concentric circles through conformal transformation. Under this category fall, e.g., rectangular and elliptical cross-sectional forms, dielectric wires between metal plates, and others. For each of these cross-sectional shapes, the QD-resonators, by analogous excitation of the $E_{01}$-wave, proportioning must always exist with regard to dimensions and resonant frequency by which the electric field lines stand perpendicularly all over the wire surface. In other cases, the conductor contour must yield contradiction by the back-transformation on the circle in field strength distribution.

Figure 7A:
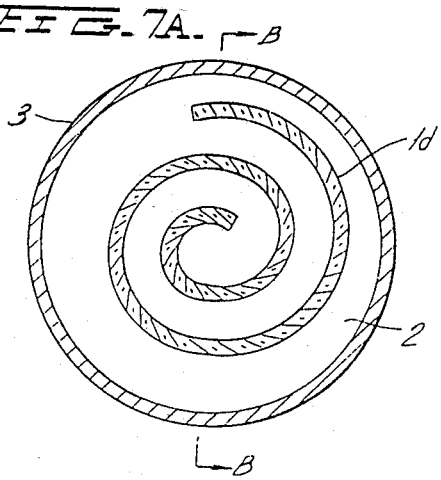
FIG. 7A is a sectional front view as seen from section line A—A of FIG. 7B, of yet another embodiment of the invention.
Figure 7B:
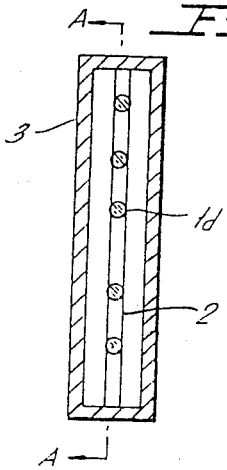
FIG. 7B is a sectional side view of the embodiment of FIG. 7A as seen from section line B—B of FIG. 7A.

The QD-resonator can be realized in principle in all those forms, as they and their varieties are known from the technique of conventional coaxial conducting resonators. The advantageous behavior of the described resonators, in the meantime, only come to their full value when the dielectric hollow cylinder between the dielectric wire and the shield tube has the greatest possible $\epsilon_1/\epsilon_2$-proportion, when the cylinder is as loss-free as possible and when no radiation and terminal losses are present. The elongated, open sides and coaxially shielded half-wave QD-resonator can be considered as the basic form. Its use lies predominantly in the microwave range. Possible development are, for example, the circular dielectric ring (see FIGS. 6A and 6B), consisting of 2, 4, 6, . . . half-wave resonators 1*c* connected in series as well as a spiral form guided dielectric wire 1*d* of half-wave total length along a shield wall 3 (see FIGS. 7A and 7B) or between two coaxial cylinders (suitably spaced). Ring form QD-resonators are suited up to the frequency range of mm-waves, while spiral form structures are most useful in the dm-wave range.

Figure 5:
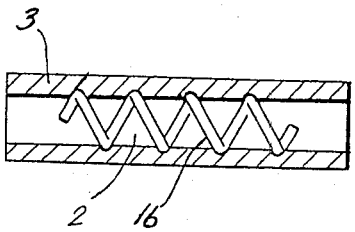

A helical dielectric wire 1*b* can also be used, accomodated in the conductive shielding 3 (see FIG. 5).

The dielectric wire can, in principle, consist of any nonmagnetic material, for example, plastic, ceramic, glass, or of a fluid embedded in an insulator tube. In the present case, ceramic and glass are preferably considered on account of the necessary mechanical stability. Various suitable ceramic materials have a dielectric constant between $\epsilon_r=10$–$100$ with a loss angle tan $\delta=(0.7$–$5)\ 10^{-4}$. There exists, also, certain titanium- or zirconium-containing strontium and barium containing ceramic mixtures which in part have very high $\epsilon_r$-values, however, also relative high loss angles. Low loss glasses are known, e.g., from the technique of light conducting glass fibers. Their suitability is conditioned, among other things, on the fact that the static dielectric constant is remarkably higher than with light frequency. The concrete uses of a certain material rises in the first line according to its electrical properties and the actual operating frequency. In the range of very high frequency, where the dielectric wire has a proportionately small dimension, a relatively expensive material (e.g., a single crystal) can be considered.

For any given quality factor, the loss angle of the dielectric wire can increase exponentially as the dielectric constant increases. With very high dielectric constant values, a material with relatively poor loss angle can therefore be employed.

A preferred range of application of QD-resonators is for filter circuits especially in the frequency range of microwaves up to the range of mm-waves, e.g., in the form of band pass filters, band-rejecting filters and others. The individual resonators are readily assembled to block or plate shapes. The coupling can take place by the usual methods as capacitively or inductively acting hole coupling, line coupling, etc. (line coupling is shown in FIG. 1C.) With thin dielectric wires (about $D_1 \leqq 1$ mm) a filter structure serves with advantage in the sense of stripline technique, preferably in triplate execution (no radiation losses). The known filter technique of such forms as half-wave end coupled and half-wave side coupled filters can, in principle, be employed here. Suitable supporting media are, e.g., plastics, ceramics or glass-like foam material. With the use of special low-loss dielectrics, one obtains already with relatively small plate spacing, significant u quality factor. The quasidielectric resonators therefore open a way to be able to construct high selective and low attenuation filter structures in the stripline technique, that one up until now has only been able to realize with voluminous cavity resonation.

Two examples of an assembled three circuit filter using the resonator of the present invention are shown schematically in FIGS. 1B and 1C. In FIG. 1B, the block resonance elements 1 are separated in three separate adjacent compartments 5 and are magnetically coupled at any given time through holes 6 in the separating walls. The dielectric hollow cylinder 7 serves to support the resonance elements. The filters are capacitively coupled to the feedline by probe 8. FIG. 1C shows an arrangement of three QD-resonators in the sense of a half-wave side coupled filter in triplate technique. The filteer of FIG. 1C includes a pair of conducting plates 9, a pair of supporting substrates 10 and a third insulating layer 11. Layer 11 has thickness equal to the diameter of the resonant elements 1 and contains openings 12 for the reception of the resonant elements 1. The layer 11 is so constructed that with the actual coupling factor, the necessary filter characteristic occurs directly. By means of the feedline 13, the filter matches the wave resistance $Z_o$ of the circuit.

Concrete development possibilities of the presented QD-resonators exist already, since various suitable dielectrics are already known. The general utility of the resonators, especially for filter circuits in stripline installations, is primarily a technical problem. The resonator can replace advantageously present devices (stripline filters, coaxial and cavity resonators) in many case of transmission technique, especially where there is dependency on a high selective and/or low attenuating filter structure with minimal dimensions.

The present invention may be embodied in other specific forms without departing from the spirit or essential attributes thereof and, accordingly, reference should be made to the appended claims, rather than to the foregoing specification as indicating the scope of the invention.

What is claimed is:

1. A resonator for high frequency electromagnetic oscillations, comprising:

means defining a generally tubular volume having one region thereof filled with a first material having a first dielectric constant;

a solid dielectric wire located within a second region of said volume, said dielectric wire being formed of a second material having a second dielectric constant which is greater than said first dielectric constant; and means for electromagnetically shielding said generally tubular volume, said means comprising a metal shield means;

the dimensions of said dielectric wire being such that, for any given resonance frequency and for said first and second dielectric constants, an $E_{0m}$-wave (circular magnetic field, $m=1,2,3,\ldots$) is established in said wire and a standing TEM-wave is established in said generally tubular volume.

2. The resonator of claim 1, wherein the length of said wire is equal to p times half the resonant wave-length, p being a positive integer.

3. The resonator of claim 2, wherein the $E_{0m}$ which is established in said wire is a $E_{0l}$-wave ($TM_{0l}$-mode).

4. The resonator of claim 3, wherein the permeability $\mu_2$ of said first material and the permeability $\mu_1$ of said second material of said dielectric wire are equal to the permeability $\mu_0$ of a vacuum and wherein the dielectric constant $\epsilon_2$ of said first material is at least approximately equal to the dielectric constant $\epsilon_0$ of a vacuum and the dielectric constant $\epsilon_1$ of said second material is substantially greater than said dielectric constant of said first material.

5. The resonator of claims 1, 2, 3 or 4, wherein said first material is predominantly air.

6. The resonator of claims 1, 2, 3 or 4, wherein said metal shield means comprises a cylindrical metal tube.

7. The resonator of claims 1, 2, 3 or 4, wherein said dielectric wire is made of a plastic material.

8. The resonator of claims 1, 2, 3, or 4, wherein said dielectric wire is formed of a ceramic material.

9. The resonator of claims 1, 2, 3, or 4, wherein said dielectric wire is formed of glass.

10. The resonator of claims 1, 2, 3, or 4, wherein said dielectric wire consists of a single crystal.

11. The resonator of claims 1 or 4, wherein said dielectric wire has an approximately circular cross-sectional shape.

12. The resonator of claims 1 or 4, wherein said dielectric wire is mounted concentrically in the interior of said generally tubular volume.

13. The resonator of claims 1 or 4, wherein the end surfaces of said dielectric wire are curved.

14. The resonator of claim 6, wherein said dielectric wire is arranged helically along said tube.

15. The resonator of claims 1 or 4, wherein said shield means comprises a pair of spaced metal plates.

16. The resonator of claim 15, wherein said dielectric wire is arranged spirally between said pair of metal plates.

17. The resonator of claims 1 or 4, wherein an even number of half-wave resonators are combined to form a circular dielectric ring.

18. A filter circuit including a plurality of individual resonators cooperating as part of a filter and wherein each of said resonators comprises:

means defining a generally tubular volume, a first region of which is filled with a first material having a first dielectric constant; means for electromagnetically shielding said generally tubular volume, said means comprising a metal shield means; and a solid dielectric wire located within a second region of said volume, said dielectric wire being formed of a second material having a second dielectric constant which is greater than said first dielectric constant, the dimensions of said dielectric wire being such that for any given resonance frequency and for said first and second dielectric constants, an $E_{0m}$ wave (circular magnetic field, m = 1,2,3, . . . ) is established in said wire and a standing TEM-wave is established in said generally tubular volume.

19. The filter of claim 18, wherein said resonators are block resonators.

20. The filter circuit of claim 18, wherein said resonators are coupled to each other by line coupling.

21. The filter circuit of claim 18, wherein said resonators are coupled to each other by inductively operative openings.

22. A filter circuit, comprising:

a first and a second supporting insulating substrate in face-to-face relation;

a third insulating layer disposed between and in contact with said substrates, said third insulating layer being made of a first material having a first dielectric constant and having a plurality of parallel cavities therein;

first, second and third solid dielectric wires disposed in respective ones of said cavities, said dielectric wires being oriented parallel to but axially offset from each other in such a manner as to permit them to cooperate as a half-wave side coupled filter, said dielectric wires being formed of a second material having a second dielectric constant greater than said first dielectric constant; and first and second conductive plates disposed respectively on the side of each of said first and second substrates opposite that in contact with said third insulating layer; the dimensions of said dielectric wires being such that, for said first and second dielectric constants, an $E_{0m}$ wave (circular magnetic field, m = 1, 2, 3 . . . ) is established in said wire and a standing TEM-wave is established in the space surrounding said dielectric wires and between said conductive plates.

* * * * *